US005687892A

United States Patent [19]

Johns

[11] Patent Number: 5,687,892

[45] Date of Patent: Nov. 18, 1997

[54] BELT MOUNTED TOOL HANGER

[76] Inventor: Gary A. Johns, 504 Geneva St., W. Dundee, Ill. 60118

[21] Appl. No.: 545,324

[22] Filed: Oct. 19, 1995

[51] Int. Cl.[6] ..... A45F 5/00

[52] U.S. Cl. ..... 224/268; 224/671; 224/904; D3/228

[58] Field of Search ..... 224/268, 149, 224/671, 672, 673, 674, 904, 913; D3/228

[56] References Cited

U.S. PATENT DOCUMENTS

| | | | |
|---|---|---|---|
| 409,239 | 8/1889 | Roller | 224/268 |
| 636,295 | 11/1899 | Sibthorpe | 224/268 |
| 2,320,067 | 5/1943 | Caughren | 224/268 |
| 3,809,349 | 5/1974 | Baedke | 224/268 |
| 3,963,156 | 6/1976 | Perrin | 224/268 |
| 4,113,156 | 9/1978 | Brito | 224/268 |
| 4,431,122 | 2/1984 | Garmong | 224/268 |
| 5,294,028 | 3/1994 | Bankroff | 224/674 |
| 5,303,860 | 4/1994 | Serafini, Jr. | 224/904 |

*Primary Examiner*—Henry J. Recla
*Assistant Examiner*—Gregory M. Vidovich
*Attorney, Agent, or Firm*—Kajane McManus

[57] ABSTRACT

The belt mounted tool hanger comprises a base member having a slot therein through and within which a portion of a workman's belt can be engaged and a hook which extends from a end edge of the base member, across same, and to a level above the height to which the base member extends.

6 Claims, 1 Drawing Sheet

BELT MOUNTED TOOL HANGER

BACKGROUND OF THE INVENTION

1. Field of the Invention

The present invention relates to a belt mounted tool hanger. More specifically, the tool hanger is of the type to snugly be accommodated on any belt a workman may wear and is provided for engaging thereon an assortment of squares, such as speed, bevel or combination levels, locking C clamps, etc.

2. Prior Art

Heretofore various belt mounted key and tool hangers have been proposed.

Examples of such structures may be found in numerous U.S. Patents.

Such hangers, for the most part, include two opposed spring clip type members, one of which slips over a belt and another of which receives therein a key ring or the like. Such spring clip design has certain disadvantages, such as sometimes falling off the belt or having the other spring clip loosen and let go of what depends therefrom, or, alternatively, makes removal of the items depending therefrom unwieldy.

As will be described in greater detail hereinafter, the belt mounted tool hanger of the present invention creates a simple, secure, and wieldly mechanism for holding a tradesman's tools thereon.

SUMMARY OF THE INVENTION

According to the invention there is provided a belt mounted tool hanger comprising an integral two section unit, one section of which comprises a base member which is narrow and high and has a slot extending therethrough within which a thickness of belt can be received and further comprising a hook which extends from and rises from a surface of the base member which is coplanar with a plane of said slot, the hook extending across the entire height of the base member and terminating in a rounded tip which extends outwardly of the hook, away from the base member.

DESCRIPTION OF THE PREFERRED EMBODIMENT

Figure 1:
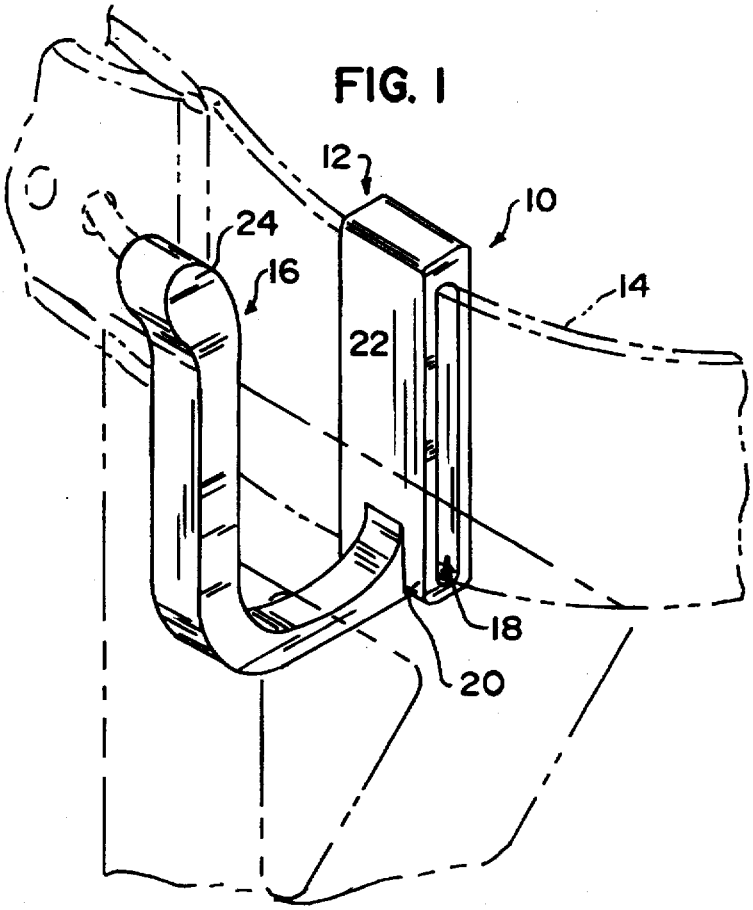
FIG. 1 is a perspective view of the belt mounted tool hanger made in accordance with the teachings herein, and shows engagement of the hanger to a belt in phantom as well as to a tool in phantom.
Figure 2:
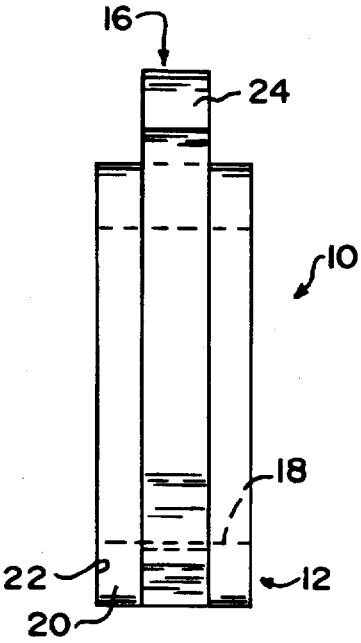
FIG. 2 is a front view of the hanger of FIG. 1.
Figure 3:
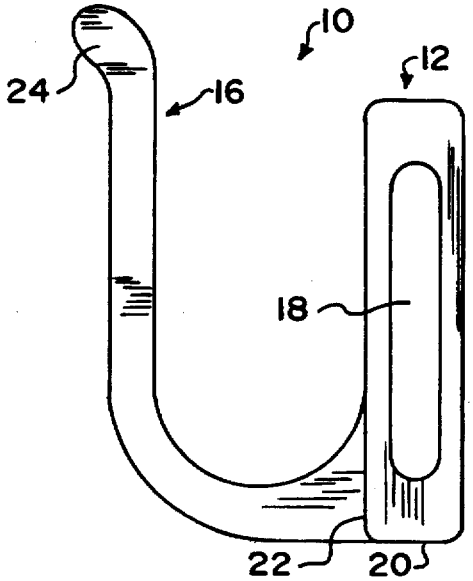
FIG. 3 is a side view of the hanger of FIG. 1.

Referring now to the drawings in greater detail, there is illustrated therein the belt mounted tool hanger made in accordance with the teachings of the present invention and generally identified by the reference numeral 10.

As shown, the hanger 10 is comprised of two sections which are formed as an integral unit. The first section 12 may be defined as a base section 12 which engages a belt 14 of a wearer. The second section 16 may be defined as a hook 16 which extends outwardly of said base section 12 in a direction perpendicular thereto.

The base section 12 is a narrow rectangular member which has a height sufficient to accommodate the height or breadth of a workman's belt. Within the base section 12 is defined a narrow, high slot 18 through which and within which a section of belt 14 is engaged as shown.

It has been found that dimensions of approximately 1¾ inches in height and approximately ¼ inches in thickness for the slot 18 will easily accommodate most varieties of a workman's belt 14.

Turning now to a study of the hook 16, it will be seen that the hook extends outwardly from and rises from one narrow end edge 20 of one surface 22 of the base member 12, the surface 22 being coplanar with the plane of the slot 18. The hook 16 extends outwardly from the base member approximately 1¼ inches and rises across the height of the base member 12 and to a level significantly above the level to which the base member 12 vertically extends by about ¾ inches terminating into a balled, outwardly angled tip 24, similar to tips provided on clothes hooks.

Such rounded, outwardly angled and elevated tip 24 assures ease in engagement and removal of tools, such as those defined above, onto and off of the hanger 10, respectively.

The dimensions of the slot 18 in the base member 12 have been found to be best suited for use so that the hanger 10 is well fixed against the wearer's body without excessive motion of the hanger 10 being created by the motion of the wearer.

The hanger 10 may be of any light weight malleable material which can be formed into the desired embodiment substantially disclosed herein.

It will be further seen that most corners of the hanger 10 are rounded, such rounding being considered beneficial when body contact with such areas is made.

As described above, the hanger 10 of the present invention provides a number of advantages, some of which have been described above and others of which are inherent in the invention. Also, modifications may be proposed to the hanger 10 without departing from the teachings herein. Accordingly the scope of the invention is only to be limited as necessitated by the accompanying claims.

I claim:

1. A method for mounting tools to a belt engaged about a torso of a workman, the method incorporating use of a belt mounted tool hanger comprising an integral two section unit, one section of which comprises a base member which is narrow and high and has a slot extending therethrough and another section of which comprises a hook which extends from and rises from a surface of the base member which is coplanar with a plane of said slot, the hook extending across the entire height of the base member and terminating in a rounded tip which extends outwardly of the hook, away from the base member, the method comprising the steps of:

slidingly engaging the tool hanger onto the belt along the length thereof, the belt being received within the slot in the tool hanger base member;

fixing the belt about the torso of the workman; positioning the tool hanger along a length of the belt at a point which is easily accessible; and hanging a tool from the tool hanger by engaging the tool over the hook of the tool hanger.

2. The method of claim 1 wherein said slot is configured to be approximately ¼ inch in thickness.

3. The method of claim 2 wherein said slot is configured to be approximately 1¾ inches in height.

4. The method of claim 3 wherein most corners of the hanger are rounded.

5. The method of claim 4 wherein said hook tip extends approximately ¾ inch above the base member.

6. The method of claim 5 wherein said hook extends approximately 1¼ inches outwardly from said base member.

* * * * *